US006411261B1

(12) United States Patent
Lilly

(10) Patent No.: US 6,411,261 B1
(45) Date of Patent: Jun. 25, 2002

(54) ARTIFICIAL MAGNETIC CONDUCTOR SYSTEM AND METHOD FOR MANUFACTURING

(75) Inventor: James D. Lilly, Silver Spring, MD (US)

(73) Assignee: E-Tenna Corporation, Laurel, MD (US)

( * ) Notice: Subject to any disclaimer, the term of this patent is extended or adjusted under 35 U.S.C. 154(b) by 0 days.

(21) Appl. No.: 09/845,011

(22) Filed: Apr. 27, 2001

Related U.S. Application Data

(60) Provisional application No. 60/271,635, filed on Feb. 26, 2001.

(51) Int. Cl.[7] ..... H01Q 15/00
(52) U.S. Cl. ..... 343/756; 342/5; 343/770
(58) Field of Search ..... 343/756, 909, 343/760 MS, 753, 767, 769, 770; 342/5

(56) References Cited

U.S. PATENT DOCUMENTS 6,175,337 B1 * 1/2001 Jasper, Jr. et al. ..... 343/770
6,218,978 B1 * 4/2001 Simpkin et al. ..... 342/5
6,262,495 B1 7/2001 Yablonovitch et al. ..... 307/101

FOREIGN PATENT DOCUMENTS

WO WO 99/50929 10/1999

OTHER PUBLICATIONS

Sievenpiper, Daniel Frederic, University of California, Dissertation, *High–Impedance Electromagnetic Surfaces,* 1999.

King Ray J., et al., IEEE Transactions on Antennas and Propagation, *The Synthesis of Surface Reactance Using an Artificial Dielectric,* vol. AP–31, No. 3, May 1983, pp. 471–476.

Synthesis of Surface Reactances Using Grounded Pin Bed Structure, 2 pages.

Sievenpiper, Dan et al., IEEE Transactions on Microwave Theory and Techniques, High–Impedance Electromagnetic Surfaces with a Forbidden Frequency Band, vol. 47, No. 11, Nov. 1999.

Diaz, Rodolfo E. et al., IEEE AP–S International Symposium, Salt Lake City, Utah, Jul. 16–21, 2000., TM Mode Analysis of a Sievenpper High–Impedance Reactive Surface, pp. 1–4.

Sievenpiper, et al., 1999 IEEE, High–Impedance Electromagnetic Ground Planes, pp. 1–4.

Wu, T.K., Editor, "Frequency Selective Surface and Grid Array", John Wiley & Sons, Inc., New York, 1995, 331 pages.

* cited by examiner

*Primary Examiner*—Don Wong
*Assistant Examiner*—James Clinger
(74) *Attorney, Agent, or Firm*—Brinks Hofer Gilson & Lione; Richard K. Clark

(57) ABSTRACT

The invention provides an artificial magnetic conductor (AMC) system and method for manufacturing. The AMC has a post plane with posts and slots. The posts are operatively disposed adjacent to conductive shapes on one or more frequency selective surfaces. The posts formably extend from the post plane.

59 Claims, 13 Drawing Sheets

PRIOR ART

ARTIFICIAL MAGNETIC CONDUCTOR SYSTEM AND METHOD FOR MANUFACTURING

This application is based on Provisional Application Ser. No. 60/271,635, entitled "Artificial Magnetic Conductor System and Method for Manufacturing" and filed on Feb. 26, 2001. The benefit of the filing date of the Provisional Application is claimed for this application.

FIELD OF THE INVENTION

This invention generally relates to frequency selective surfaces. More particularly, this invention relates to systems and methods for manufacturing artificial magnetic conductors.

BACKGROUND OF THE INVENTION

An artificial magnetic conductor (AMC) generally is an engineered material having a planar, electrically thin, anisotropic structure that is a high-impedance surface for electromagnetic waves. The electrically thin structure has a typical height in the range of about $\lambda/100$ through about $\lambda/50$, where $\lambda$ is a free space wavelength. At microwave frequencies in the range of about 300 MHz through about 3 GHz, the structure also is physically thin. A typical AMC structure is two-layered, periodic, and magnetodielectric, and is engineered to have a specific tensor permittivity and permeability behavior with frequency in each layer. The AMC properties may be limited over a frequency band or bands. Near the resonant frequency of the structure, the reflection amplitude is near unity and the reflection phase at the surface is near zero degrees. When operating as a high impedance surface, an AMC suppresses transverse electric (TE) and transverse magnetic (TM) mode surface waves over one or more frequency bands.

The high impedance surface may be used in antenna and similar applications. The antenna applications include "paste-on" antennas, internal and wireless handset antennas, global positioning satellite (GPS) antennas, and the like. Other applications include suppressing surface waves, mitigating multi-path signals near the horizon, reducing the absorption of radiated power, directing the radiation pattern, and lowering the aperture size and weight.

FIG. 14 is an AMC according to the prior art. The AMC may be made using printed circuit board manufacturing and other methods know in the art to form a "bed of nails" structure—a frequency selective surface (FSS) connected by vias to a backplane. A spacer or dielectric layer is disposed adjacent to the backplane. The spacer layer may be any material suitable for a printed circuit board substrate such as a fiber reinforced polymer, a copper laminate epoxy glass (FR4), and the like. The backplane is made from a metal such as copper. The vias are plated-through holes formed in the spacer layer and are made of a metal such as copper. The vias may be hollow or solid and are connected to the backplane. The FSS has conductive shapes printed on a substrate. The conductive shapes are made of a metal such as copper and are conductively attached to the vias. The substrate typically is much thinner than the spacer layer and may be any material suitable for a printed circuit board substrate such as polyimide.

The vias, multi-layer construction, and dissimilar layers and substrates increase manufacturing costs. The type of dielectric material also may increase the cost of AMC antennas. The dielectric material typically used as the spacer layer is relatively heavy and represents as much as 98 percent of the weight of a finished AMC. This dielectric material also may contribute significantly to the cost of thicker AMC designs. This dielectric material makes the spacer layer more rigid, so that the resulting AMC is rigid and planar. A rigid AMC may not be suitable for some applications such as those requiring a conformable (non-planar) or flexible AMC.

SUMMARY

This invention provides an artificial magnetic conductor (AMC) system and manufacturing method. The AMC has one or more posts or post assemblies formably extending from a post plane adjacent to one or more frequency selective surfaces.

The AMC may comprise a post plane and one or more frequency selective surfaces in one embodiment. The post plane has one or more posts and one or more slots. The one or more posts formably extend from the post plane. The frequency selective surfaces have one or more conductive shapes. The posts are operatively disposed adjacent to the conductive shapes.

The AMC also may comprise one or more frequency selective surfaces and a post plane in another embodiment. The post plane has one or more post assemblies and one or more slots. The one or more post assemblies formably extend from the post plane. Each post assembly has one or more posts and one or more plates. The one or more plates are operatively disposed adjacent to the one or more frequency selective surfaces.

In a method for manufacturing an AMC, one or more posts and one or more slots are formed in a post plane. The one or more posts formably extend from the post plane. The one or more posts are operatively disposed adjacent to one or more frequency selective surfaces.

In another method for manufacturing an AMC, one or more post assemblies and one or more slots are formed in a post plane. Each post assembly has one or more posts and one or more plates. The one or more posts formably extend from the post plane. The one or more plates are operatively disposed adjacent to one or more frequency selective surfaces.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

FIG. 2A represents a top view of the AMC; and FIG. 2B represents a side view of the AMC.

FIG. 3A is a side view of an AMC having a conductive shape operatively attached to a post according to one aspect; FIG. 3B is a side view of an AMC having a conductive shape operatively attached to a post according to another aspect; and where FIG. 3C is a side view of an AMC having a space between a conductive shape and a post according to another aspect.

FIG. 4A represents a side view of the AMC having a space between the frequency selective surface and the posts; and where FIG. 4B represents a side view the AMC with no space between the frequency selective surface and the posts.

FIG. 11A represents a top view of the post assembly as initially formed in the post plane; and FIG. 11B represents a perspective view of the post assembly as configured to position a plate adjacent or connected to a frequency selective surface.

FIG. 12A represents a top view of the post assembly as initially formed in the post plane; and FIG. 12B represents a perspective view of the post assembly as configured to position a plate adjacent or connected to a frequency selective surface.

DETAILED DESCRIPTION OF THE PREFERRED EMBODIMENTS

Figure 1:
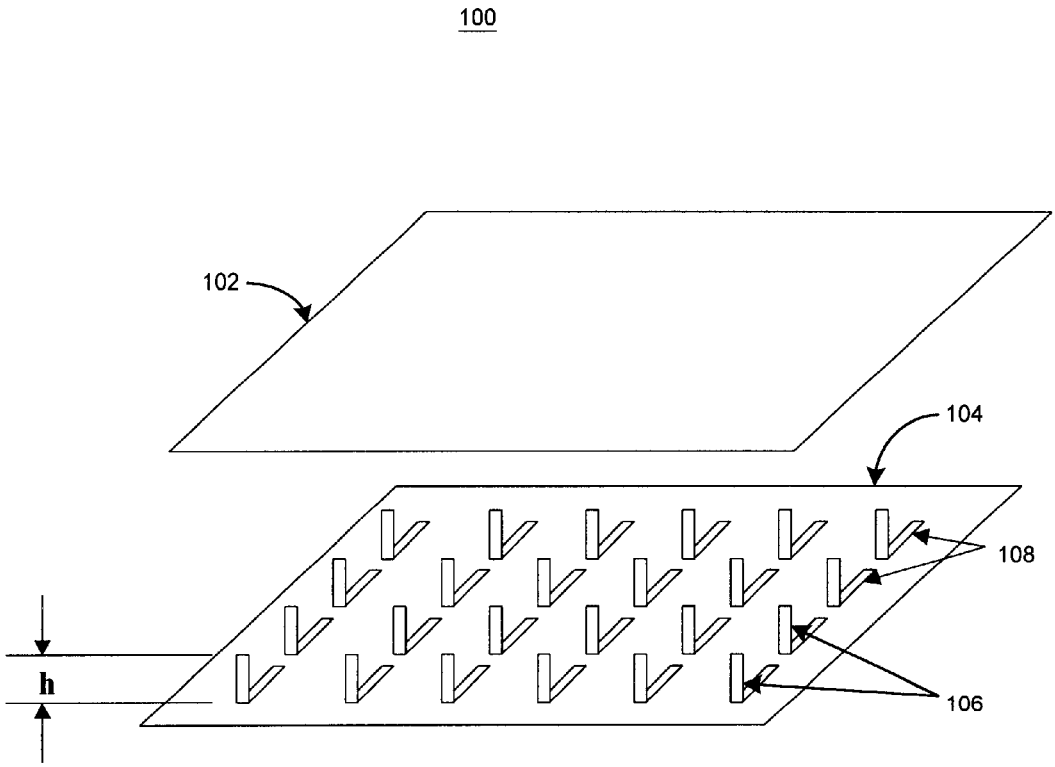
FIG. 1 represents perspective view of an unassembled artificial magnetic conductor (AMC) according to a first embodiment.
Figure 2A:
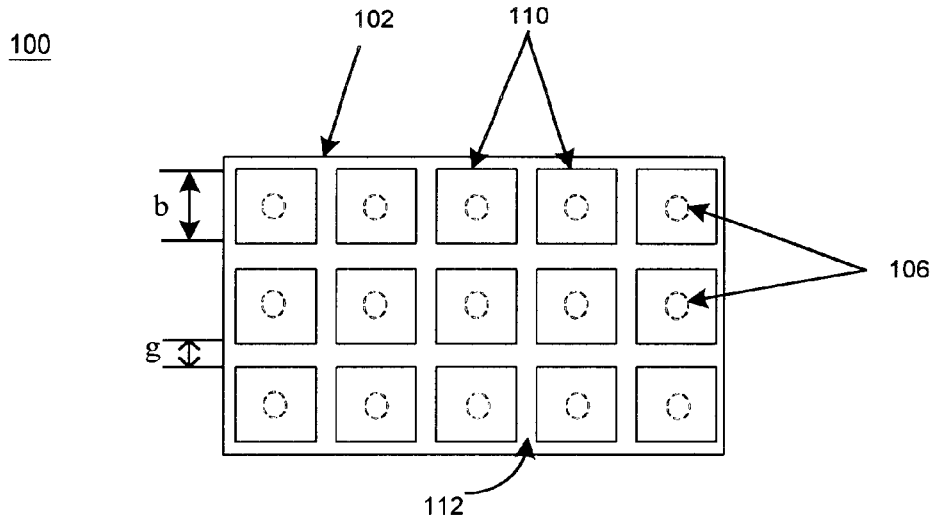
FIGS. 2A and 2B represent assembled views of the AMC in FIG. 1, where.
Figure 2B:
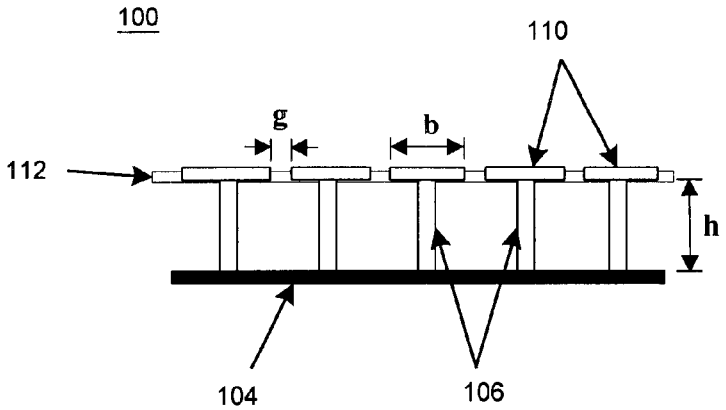

FIGS. 1–2 represent an artificial magnetic conductor (AMC) 100 according to a first embodiment. FIG. 1 represents a perspective view of an unassembled AMC 100. FIG. 2A represents a top view of the AMC 100 as assembled. FIG. 2A represents a side view of the AMC 100 as assembled. The AMC 100 may be an antenna or similar device and may be part of or connected to an electronic device (not shown) such as a wireless communication device (cellular telephone, radio, etc.), a GPS device, and the like. While components are shown in a particular configuration, other or additional components and different configurations may be used.

The AMC 100 comprises a frequency selective surface (FSS) 102 operatively disposed adjacent to one or more tabs or posts 106, which formably extend from a post plane 104. In one aspect, the FSS 102 may be connected to the posts 106 when assembled. In another aspect, there may be a space between the FSS 102 and the posts 106 as discussed below. The FSS 102 includes one or more conductive shapes 110 printed or plated onto a substrate 112. The conductive shapes 110 may be in one or more layers. The substrate 112 may be thinner than the height, h, of the posts 106 and may be any material suitable for a printed circuit board substrate such as polyimide. The conductive shapes 110 may be any shapes or combination of shapes suitable for operation of the AMC 100, including rectangles, hexagons, or loops. The conductive shapes 110 are arranged periodically on the substrate 112 and separated by a gap, g. In one aspect, the conductive shapes 110 have a square configuration with a side, b. The conductive shapes 110 may be made of one or more electrically conductive materials and may be conductively attached to the posts 106. Conductively attached includes physical and non-physical connections between the posts 106 and the conductive shapes 110 suitable for operation of the AMC 100. Electrically conductive materials include metals such as copper in elemental or near elemental form, alloys, composites, and other materials having suitable electrical properties for operation of the AMC 100.

The posts 106 formably extend from the post plane 104. A portion of the post plane 104 forms each post 106, leaving a slot or voided area 108 in post plane 104. The slots 108 essentially reduce the surface area of the post plane 104, which may reduce the weight of the AMC 100. The post plane 104 may be made from one or more materials having suitable electrical conductive and plastic deformation properties. In one aspect, the post plane 104 comprises copper or a copper alloy. In another aspect, the post plane 104 comprises aluminum or an aluminum alloy.

Stamping, vacuum forming, chemical milling, casting, die-casting, other processes, or a combination of such processes may form the tabs or posts 106 in the post plane 104. In one aspect, a sheet of metal or the post plane 104 is stamped, chemically milled, or otherwise machined to create tabs or the posts 106, which are connected to the sheet at one end. Each post 106 is cut and bent out of the plane of the sheet, leaving a slot 108 in the sheet or post plane 104 and creating a post 106 formably extending toward the FSS 102. All or some of the posts 106 may be essentially parallel to each other. The posts 106 may be at about a right angle or other selected angle to the post plane 104. The posts 106 may be slanted at an angle within the range of about 60 through about 90 degrees relative to the post plane 104. The posts 106 may be slanted at a common angle. The tabs or posts 106 may be formed at the same time or sequentially. In one aspect, the height of the tabs above the post plane is in the range of about 0.060 inches through about 0.250 inches. In another aspect, the height of the tabs above the post plane is in the range of about $0.005\lambda$ through about $0.05\lambda$, where $\lambda$ is the wavelength. The period and lattice arrangement of the posts 106 may match the periodic features of the FSS 102. The period may be as small as about 0.2 inches for a square lattice. In one aspect, the period may be as small as about 0.2 inches for a square lattice. In another aspect, the period may be as small as about $0.02\lambda$ for a square lattice. In a further aspect, the period of the posts may be much smaller than the period of the FSS such that one unit cell of the AMC contains multiple posts.

The posts 106 are operatively disposed adjacent and may be attached to the FSS 102. Operatively disposed includes non-conductive attachment and conductive attachment. Non-conductive attachment may be done using an adhesive. Conductive attachment may be done by soldering or conductive adhesive.

Figure 3A:
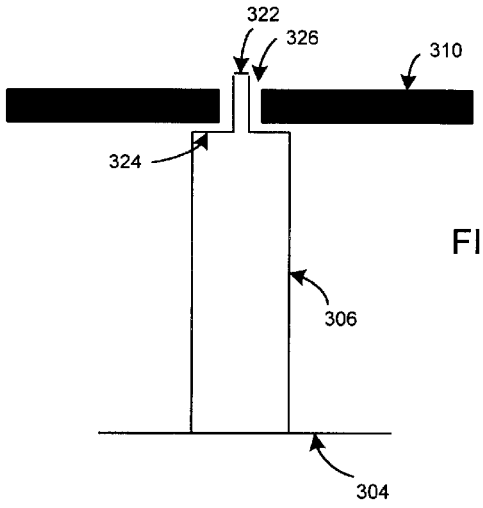
FIGS. 3A, 3B, and 3C represent side views of a conductive shape operatively disposed adjacent to a post in an AMC according to alternative embodiments; where
Figure 3B:
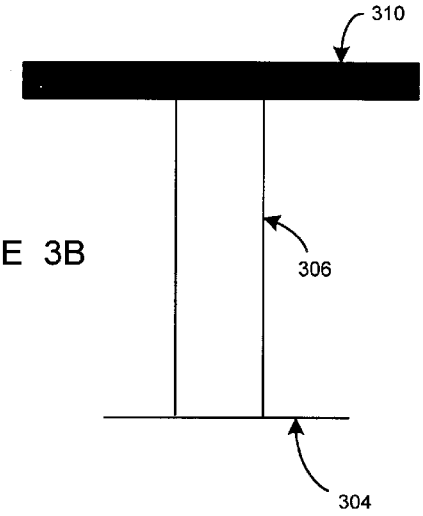
Figure 3C:
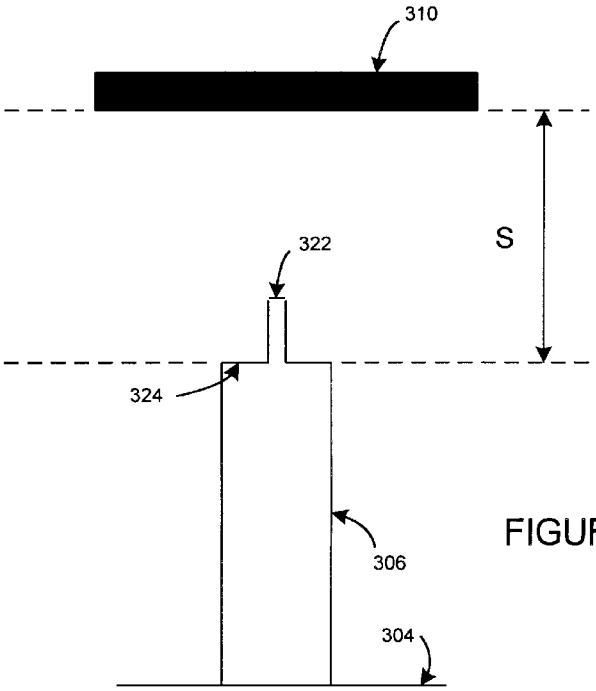

FIGS. 3A, 3B, and 3C are side views of a conductive shape 310 operatively disposed adjacent to a post 306 in an AMC according to alternative embodiments. Other arrangements may be used where the conductive shape 310 is operatively disposed adjacent to the post 306. In FIG. 3A, the post 306 formably extends from a post plane 304. The post 306 has a pin 322 extending from a shoulder 324. The pin 322 protrudes partially or completely through an aperture 326 formed in the conductive shape 310. The shoulder 324 may establish the spacing between the post plane 304 and the conductive shape 310. The post 306 and the pin 322 may not have a physical connection with the conductive shape 310. An adhesive, solder, or other material (not shown) may be disposed in the aperture 326, essentially surrounding the pin 322. In FIG. 3B, the post 306 formably extends from a post plane 304. The post 306 may have a physical connection with the conductive shape 310 by soldering, adhesive, and the like. In FIG. 3C, the post 306 formably extends from a post plane 304. The post 306 has a pin 322 extending from a shoulder 324. Alternatively, the post 306 may not have a pin extending from a shoulder. The conductive shape 310 is disposed in a space S from the post 306. In one aspect, the space S comprises the volume between the conductive shape 310 and the shoulder 324. The space S may comprise other volumes such as the volume between the pin 322 and the conductive shape 310. The period of the posts 306 in the AMC may be selected to reduce or eliminate the electrical or conductive contact between the post 306 and the conductive shape 310. In one aspect, if the period of the posts in the AMC is less than the height h of the posts (see FIG. 1), then the posts 306 do not have to be in electrical or conductive contact with the conductive shape 310. In another aspect, if the period of the posts in the AMC is less than or equal to about one-half of the height h of the posts, then the posts 306 do not have to be in electrical or conductive contact with the conductive shape 310.

Figure 4A:
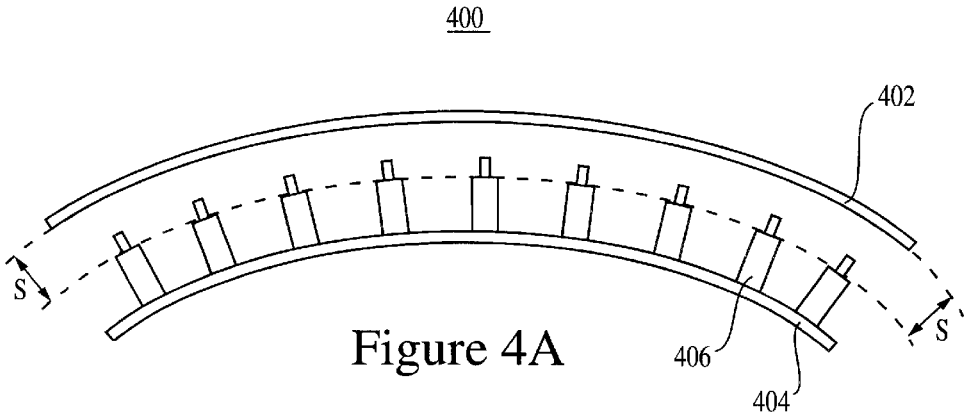
FIGS. 4A and 4B represent side views of an AMC according to a second embodiment; where
Figure 4B:
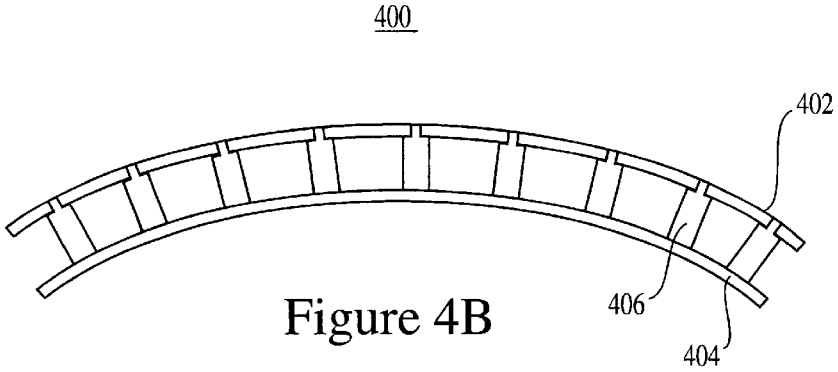
Figure 5:
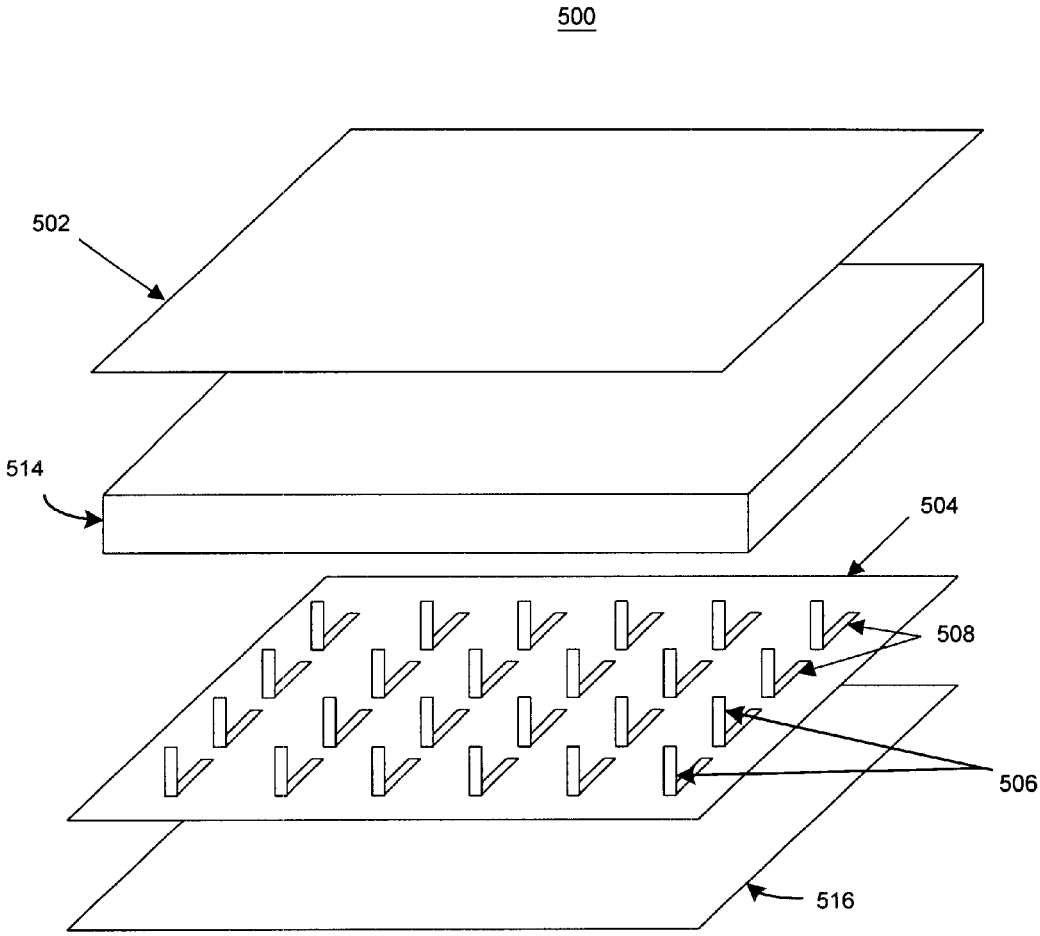
FIG. 5 represents a perspective view of an unassembled AMC according to a third embodiment.

FIGS. 4A and 4B represent side views of an artificial magnetic conductor (AMC) 400 according to a second embodiment. The AMC has a curvilinear configuration. Curvilinear includes any non-linear configuration including an arcs and combinations of non-linear configurations. A curvilinear configuration may include any non-planar configuration and may have different curved, arc, and planar shapes along different axes. The AMC comprises a frequency selective surface (FSS) 402 operatively disposed adjacent to one or more posts 406, which formably extend from a post plane 404. In one aspect, the FSS 402 may be connected to the posts 406 when assembled. In another aspect, there may be a space between the FSS 402 and the posts 406 as previously discussed. FIG. 4A represents a side view of the AMC 400 having a space between the FSS 402 and the posts 406. FIG. 4B represents a side view of the AMC 400 with no space S between the FSS 402 and the posts 406. A portion of the post plane 404 forms each post 406, which formably extend from the post plane 404. As discussed below, a dielectric layer (not shown) may be disposed between the FSS 402 and the post plane 404 and a backing film 416 (not shown) may be disposed adjacent to the post plane. FIG. 5 represents a perspective view of an unassembled artificial magnetic conductor (AMC) 500 according to a third embodiment. The AMC 500 comprises a frequency selective surface (FSS) 502 operatively disposed adjacent to one or more posts 506, which formably extend from a post plane 504. In one aspect, the FSS 502 may be connected to the posts 506 when assembled. In another aspect, there may be a space between the FSS 502 and the posts 506 as previously discussed. A portion of the post plane 504 forms each post 506, leaving a slot or voided area 508 in the post plane 504. The posts 506 formably extend from the post plane 504 and operatively connect to the FSS 502 in one aspect. A dielectric layer 514 is disposed between the FSS 502 and the post plane 504. A backing film 516 is disposed adjacent to the post plane. While components are shown in a particular configuration, other or additional components and different configurations may be used.

The dielectric layer 514 is disposed between the FSS 502 and the post plane 504. The dielectric layer 514 may be any material suitable for a printed circuit board substrate such as a fiber reinforced polymer, a copper laminate epoxy glass (FR4), and the like. The dielectric layer 514 may be air or another suitable gas or liquid or solid material. The posts 506 extend through the dielectric layer 514. In one aspect, holes or suitable openings are drilled or punched in the dielectric layer 514 to receive the posts 506. In another aspect, the dielectric layer 514 is cast in a liquid form around the posts 506. The liquid form subsequently dries or cures into a solid.

The backing film 516 is conductive and may electrically short the slots 508 in the post plane 504. Without the backing film, the slots 508 may provide anisotropic impedance to the flow of electric currents on the post plane 504. The anisotropic impedance may be a problem for some applications. The backing film 516 may be made from one or more electrically conductive materials such as copper or aluminum tape.

Figure 6:
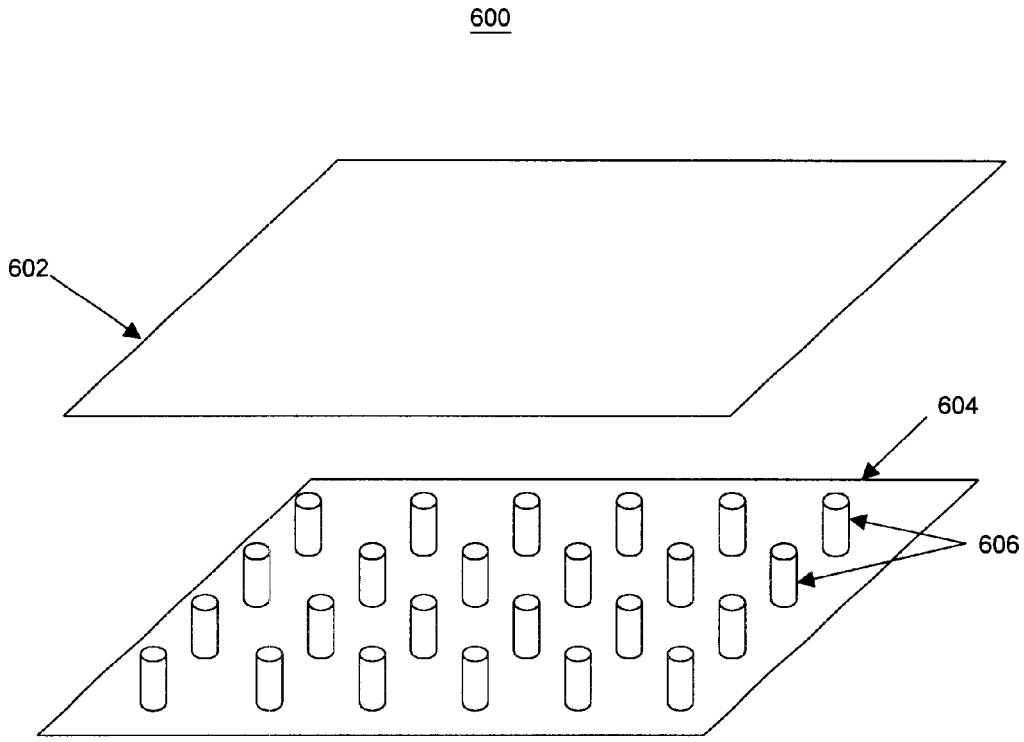
FIG. 6 represents a perspective view of an unassembled AMC according to a fourth embodiment.

FIG. 6 represents a perspective view of an unassembled artificial magnetic conductor (AMC) 600 according to a fourth embodiment. The AMC 600 comprises a frequency selective surface (FSS) 602 operatively disposed adjacent to one or more tabs or posts 106, which formably extend from a post plane 104. In one aspect, the FSS 602 may be connected to the posts 106 when assembled. In another aspect, there may be a space between the FSS 602 and the posts 606 as previously discussed. A portion of the post plane 604 forms each post 606. The posts 606 formably extend from the post plane 604 and operatively connect to the FSS 602 in one aspect. While posts are shown in a square lattice configuration, other lattice configurations may be used, such as triangular or hexagonal.

Figure 7:
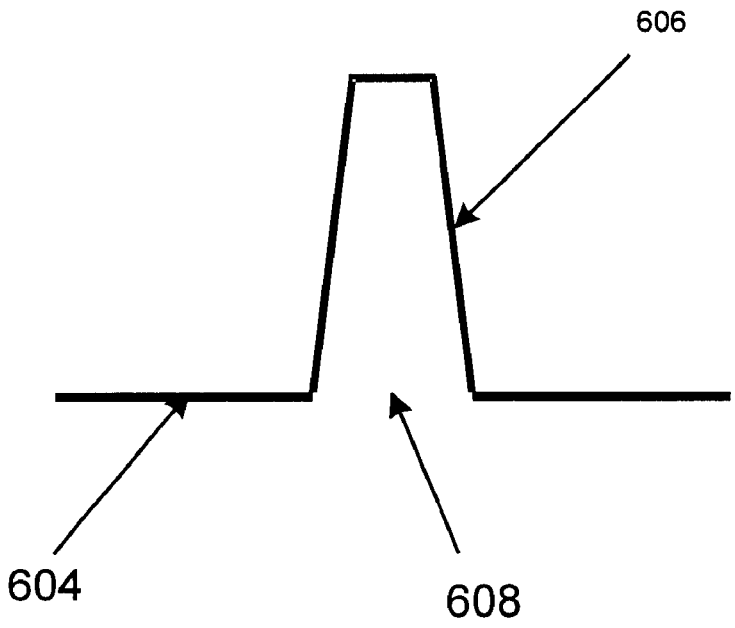
FIG. 7 represents a side view of a post formed by a portion of a post plane for an AMC according to the fourth embodiment.

FIG. 7 shows a side view of a projection or post 606 formed by a portion of the post plane 604 for the AMC 600. In one aspect, a sheet of metal or the post plane 604 is drawn, pressed, vacuum formed, or otherwise deformed to create an inverted, cone-shaped post 606. The post 606 may have an essentially flat top surface to operatively attach to the FSS. The post 606 also may form a shoulder (not shown) and a pin (not shown) to operatively attach to the FSS. The post 606 creates a slot or voided area 608 in the post plane 604, where the slot 608 is essentially covered or surrounded by the post 606. This configuration may reduce or eliminate the potential leakage of electromagnetic energy through the post plane 604 without the use of a backing film.

Figure 9:
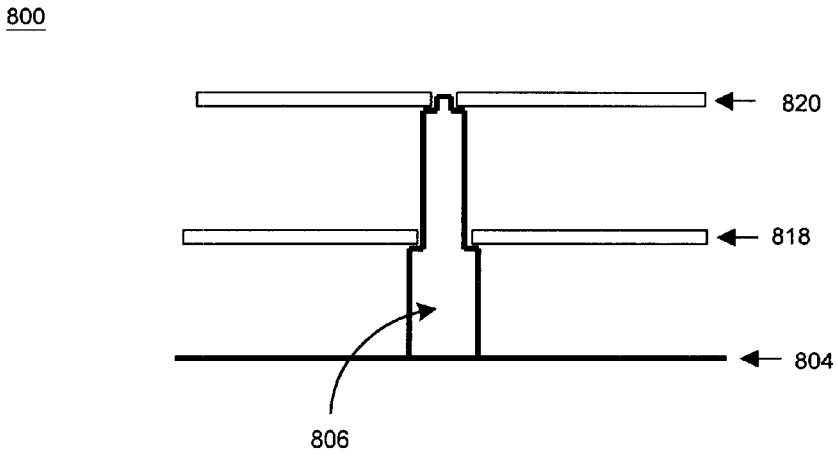
FIG. 9 represents a side view of a shoulder tab or post formed by a portion of a post plane for an AMC according to the fifth embodiment.
Figure 8:
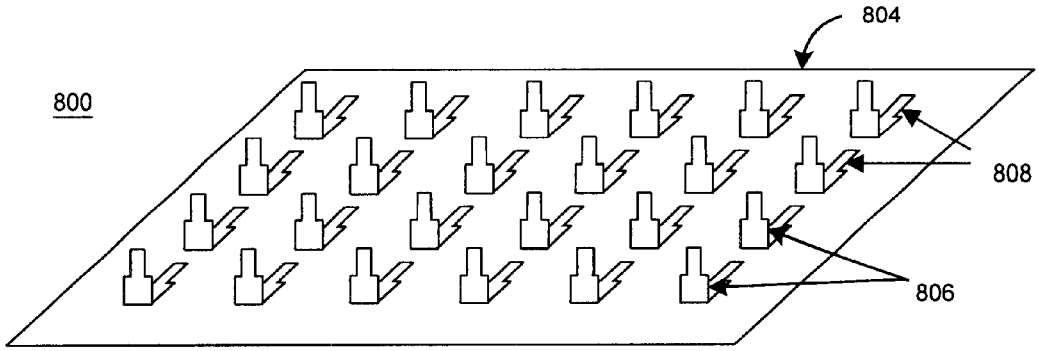
FIG. 8 represents a perspective view of a post plane for an AMC according to a fifth embodiment.

FIGS. 8 and 9 represent an artificial magnetic conductor (AMC) 800 according to a fifth embodiment. FIG. 8 is a perspective view of a post plane 804 for the AMC 800. FIG. 9 is a side view of a shoulder tab or post 806 formed by a portion of the post plane 804 for the AMC 800. The AMC 800 comprises a first frequency selective surface (FSS) layer 818 and a second frequency selective surface (FSS) layer 820 connected by one or more posts 806 to a post plane 804. A portion of the post plane 804 forms each post 806. The posts 806 formably extend from the post plane 804 and operatively connect to the first and second FSS layers 818 and 820. In one aspect, a sheet of metal or the post plane 804 is mechanically stamped to form the shoulder tabs or posts 806. The shoulder tabs 806 may have two shoulders of different sizes to support the first and second FSS layers 818 and 820. This embodiment may be used to provide a dual-band AMC. While components are shown in a particular configuration, other or additional components of a different configuration may be used such as an extrusion similar to FIG. 7.

Figure 10:
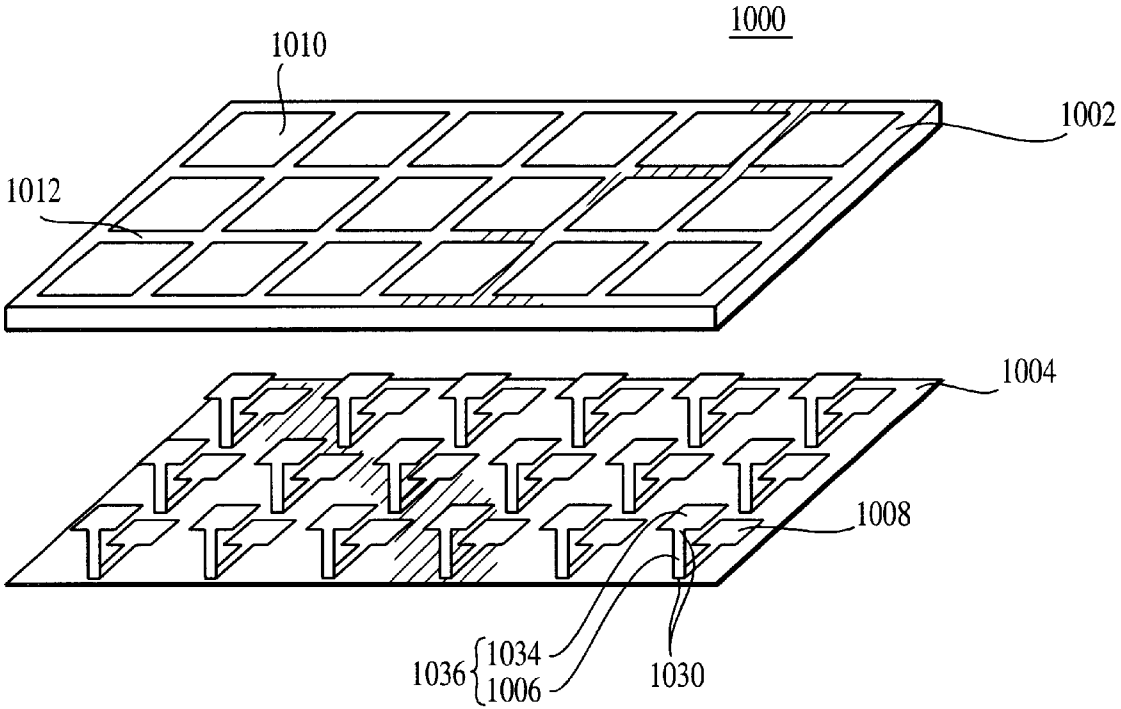
FIG. 10 represents a perspective view of an unassembled AMC according to a sixth embodiment.

FIG. 10 represents a perspective view of an unassembled artificial magnetic conductor (AMC) 1000 according to a sixth embodiment. The AMC 1000 comprises a frequency selective surface (FSS) 1002 operatively disposed adjacent to a post plane 1004. Operatively disposed includes capacitive coupling, conductively attached, and other arrangements suitable for operation of the AMC 1000. Conductively attached includes physical and non-physical connections. The AMC 1000 may have a dielectric layer (not shown) disposed between the FSS 1002 and the post plane 1004. The AMC 1000 also may have a backing film (not shown). The FSS 1002 and post plane 1004 may have flat, curvilinear, or other configurations. The post assemblies 1036 formably extend from the post plane 1002. Each post assembly 1036 comprises a post 1006 and a plate 1034, which may be formed to be parallel to the FSS 1002. The plate 1034 may be capacitively coupled to the FSS through an air or dielectric layer. While components are shown in a particular configuration, other or additional components and different configurations may be used. The FSS 1002 has one or more conductive shapes 1010 arranged on a substrate 1012. In one aspect, the conductive shapes 1010 have rectangular configurations and are arranged in a periodic formation. The conductive shapes 1010 may have a hexagonal, loop, or other configurations and may be arranged in another periodic or suitable formation. The conductive shapes 1010 may be arranged in one or more layers, forming a single or double-sided FSS or another configuration. If the conductive shapes 1010 are arranged in layers, the conductive shapes in one layer maybe offset to the conductive shapes in another layer. The substrate 1012 may be a dielectric or other suitable material.

The post plane 1004 has one or more post assemblies 1036. A portion of the post plane 1004 forms each post assembly 1036, leaving a slot or voided area 1008 in the post plane 1004. The post assemblies 1036 may be arranged in a periodic or other suitable configuration and may be arranged to increase the number of post assemblies 1036 obtained from the post plane 1004. The post assemblies 1036 may have the same or different configurations and may have the same or variable orientations. The post assemblies 1036 may have an alternating orientations, where adjacent post assemblies 1036 are arranged in different or opposite directions.

The post 1006 and the plate 1034 are configured along one or more hinge or bend portions 1030 to form the post assembly 1036. When assembled, the plate 1034 may be operatively disposed adjacent or may be connected to the FSS 1002. The post assembly 1034 may provide a RF connection between the posts 1006 and the FSS 1002, without using solder or other connection techniques. Each post assembly 1036 may have multiple posts (not shown) and multiple plates (not shown). The post 1006 and plate 1034 may have essentially straight and flat shapes and may have other shapes including curvilinear and other configurations. The post 1006 and plate 1034 may form a single curvilinear shape having one hinge or bend portion 1030 for connection to the post plane 1004. Some or all of the posts 1006 may be essentially parallel to each other and slanted at a common angle relative to the post plane 1004. The posts 1006 may be at a right angle or other selected angle relative to the post plane 1004. The posts 1006 may form an angle in the range of about 60 through about 90 degrees relative to the post plane 1004. The plates 1034 are essentially parallel to at least one of the FSS 1002 and the post plane 1004. The plates 1034 may have flat, curvilinear, or other suitable configurations, which may be the same as the FSS 1002 and the post plane 1004.

The plates 1034 may be operatively disposed adjacent to the conductive shapes 1010 in the FSS 1002. In one aspect, the plates 1034 are disposed to form a space between the plates 1034 and the FSS 1002. A dielectric film (not shown) may form or essentially fill the space. The dielectric film may be part or an extension of the dielectric layer between the FSS and the post plane as previously discussed. In another aspect, the plates 1034 are connected to one or more of the conductive shapes 1010 in one or more layers of the FSS 1002. The plates 1034 may be connected to the conductive shapes using an adhesive, solder, or another suitable connection medium. In a further aspect, the plates 1034 form one or more of the conductive shapes 1010 in a single layer or single-sided FSS. In yet another aspect, the plates 1034 form one or more of the conductive shapes 1010 in a multiple layer FSS. The plates 1034 may form part or all of the bottom layer of conductive shapes 1010 in a double layer or double-sided FSS.

Figure 11B:
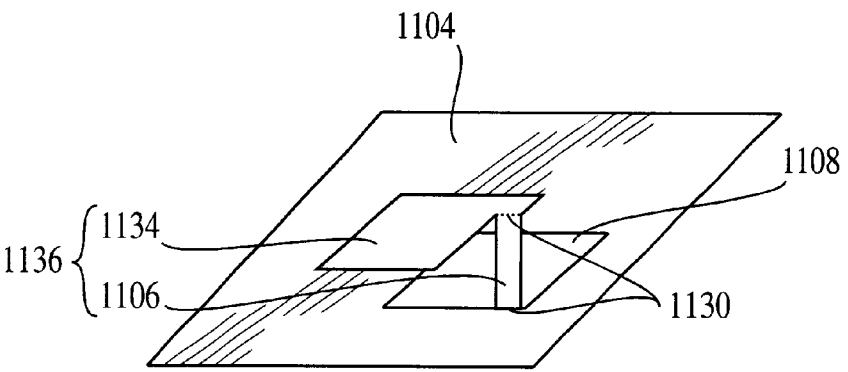
FIGS. 11A and 11B represent one embodiment of a post assembly in a post plane for an AMC; where
Figure 11A:
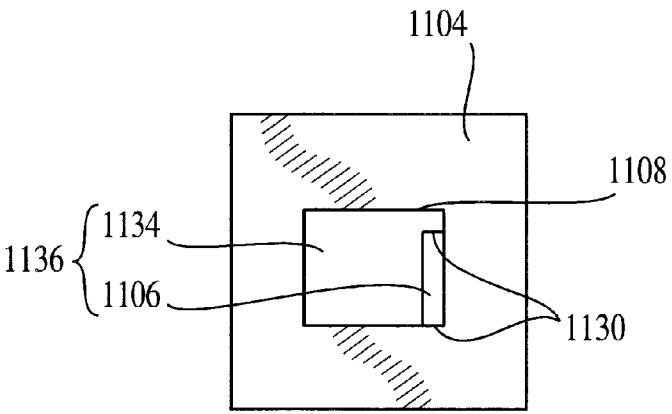

FIGS. 11A and 11B represent one embodiment of a post assembly 1136 in a post plane 1104 for an artificial magnetic conductor (AMC). The post assembly 1136 comprises a post 1106 and a plate 1134 configured at hinge or bend portions 1130. The post assembly 1136 forms a slot 1108 in the post plane 1104. FIG. 11A represents a top view of the post assembly 1136 as initially formed in the post plane 1104. FIG. 11B represents a perspective view of the post assembly 1136 as configured in one aspect to position the plate 1134 adjacent or connected to a frequency selective surface.

Figure 12B:
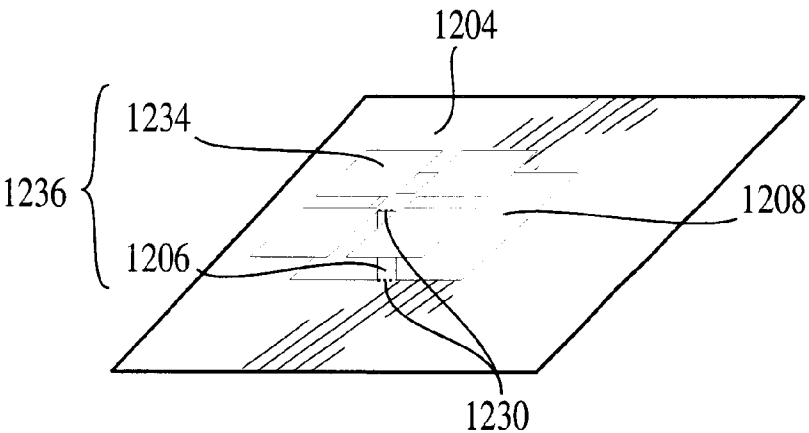
FIGS. 12A and 12B represent another embodiment of a post assembly in a post plane for an AMC; where
Figure 12A:
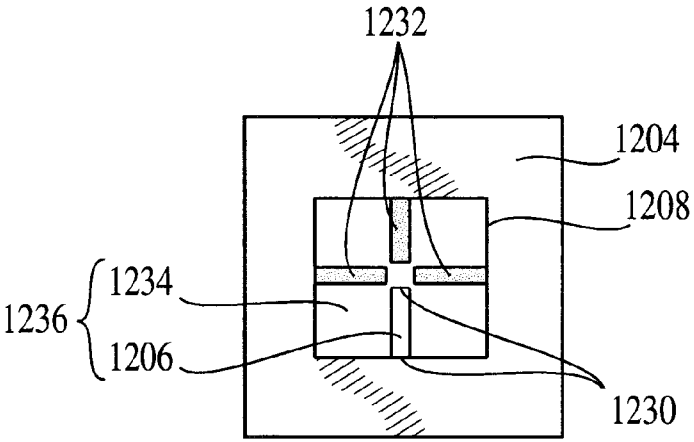

FIGS. 12A and 12B represent another embodiment of a post assembly 1236 in a post plane 1204 for an artificial magnetic conductor (AMC). The post assembly 1236 forms a slot 1208 in the post plane 1204 and comprises a post 1206 and a plate 1234 configured at hinge or bend portions 1230. The plate 1234 has open sections 1232, which form the plate 1234 into a "rectangular-cloverleaf" configuration. Other configurations may be used including those with more or less open sections and those forming curvilinear and other shapes. FIG. 12A represents a top view of the post assembly 1236 as initially formed in the post plane 1204. FIG. 12B represents a perspective view of the post assembly 1236 as configured in one aspect to position the plate 1234 adjacent or connected to a frequency selective surface.

Figure 13:
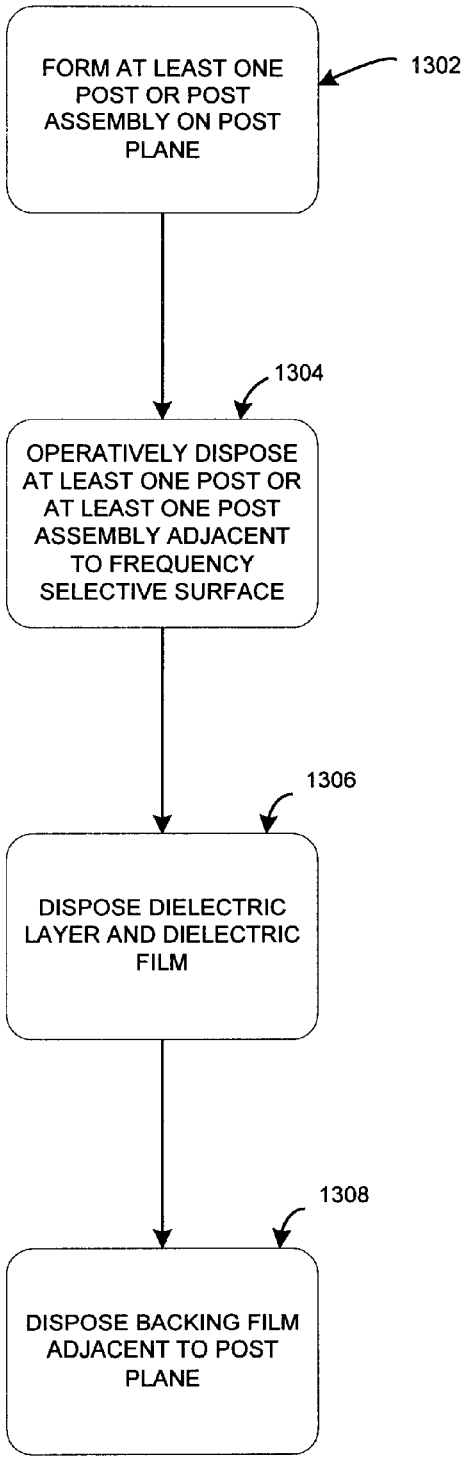
FIG. 13 represents a flowchart of a method for manufacturing an AMC.
Figure 14:
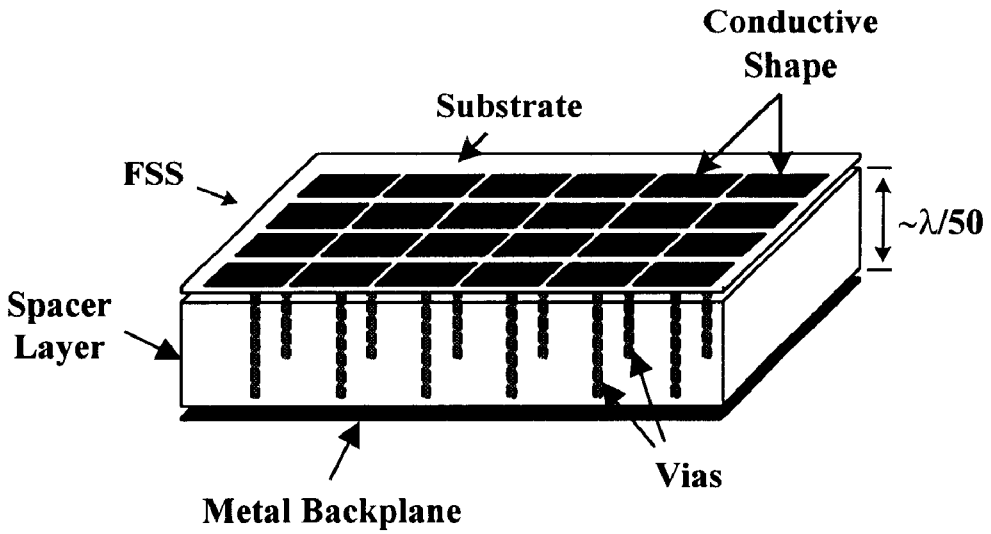
FIG. 14 is an AMC according to the prior art.

FIG. 13 represents a flowchart of a method for manufacturing an artificial magnetic conductor (AMC). In 1302, one or more posts or post assemblies are formed in a post plane. The formation of the posts or post assemblies creates one or more voided areas or slots. As previously discussed, the posts may be tabs or projections and the post assemblies may comprise a post and a plate. Stamping, vacuum forming, chemical etching, casting, die-casting, other processes, and a combination of these processes may be used to form the posts or the post assemblies. In 1304, the posts or post assemblies are operatively disposed adjacent to some or all of the conductive shapes in a frequency selective surface (FSS). In one aspect, the posts or post assemblies are bent or otherwise fashioned to formably extend from the post plane toward the FSS. In the post assemblies, the plates are bent or otherwise fashioned into position adjacent or connected to the FSS. As previously discussed, the posts may be conductively or non-conductively attached to the conductive shapes. The posts may have double shoulders for connection to first and second FSS layers. The plates in the post assemblies may form and may be connected to one or more of the conductive shapes on the FSS. In 1306, a dielectric layer may be disposed between the post plane and the FSS. A dielectric film may be disposed between the plates and the FSS. As previously discussed, the dielectric film may be part or an extension of the dielectric layer. The dielectric layer and dielectric film may be air and any suitable dielectric material as previously discussed. In 1308, a backing film may be disposed adjacent to the post plane.

Various embodiments of the invention have been described and illustrated. However, the description and illustrations are by way of example only. Other embodiments and implementations are possible within the scope of this invention and will be apparent to those of ordinary skill in the art. Therefore, the invention is not limited to the specific details, representative embodiments, and illustrated examples in this description. Accordingly, the invention is not to be restricted except in light as necessitated by the accompanying claims and their equivalents.

What is claimed is:

1. An artificial magnetic conductor (AMC), comprising:

a post plane having at least one post and at least one slot, where the at least one post formably extends from the post plane; and at least one frequency selective surface having at least one conductive shape, where the at least one post is operatively disposed adjacent to the at least one conductive shape.

2. The AMC according to claim 1, where the at least one post comprises a tab.

3. The AMC according to claim 2, where the tab comprises at least one shoulder.

4. The AMC according to claim 3, where:

the tab further comprises a pin;

the at least one conductive shape forms a hole; and the pin is disposed in the hole.

5. The AMC according to claim 3, where:

the at least one frequency selective surface comprises a first FSS layer and a second FSS layer; and the at least one shoulder comprises two shoulders operatively connected to the first and second FSS layers.

6. The AMC according to claim 1, where:

the at least one post comprises at least one projection;

the at least one voided area comprises at least one slot; and the at least one projection essentially covers the at least one slot.

7. The AMC according to claim 1, where the at least one conductive shape has an essentially rectangular configuration.

8. The AMC according to claim 1, where the at least one conductive shape and the at least one post have essentially the same periodic arrangement.

9. The AMC according to claim 1, where the at least one frequency selective surface further comprises a substrate.

10. The AMC according to claim 1, further comprising a dielectric layer disposed between the post plane and the at least one frequency selective surface.

11. The AMC according to claim 10, where the dielectric layer comprises at least one of a fiber reinforced polymer and a copper laminate epoxy glass.

12. The AMC according to claim 10, where the dielectric layer comprises air.

13. The AMC according to claim 1, further comprising a backing film disposed adjacent to the post plane.

14. The AMC according to claim 1, where the at least one frequency selective surface forms a space between the frequency selective surface and the at least one post.

15. The AMC according to claim 1, where the at least one post comprises a plurality of posts having a period less than the height of the posts.

16. The AMC according to claim 15, where the period is less than or equal to about one-half the height of the posts.

17. The AMC according to claim 1, where the frequency selective surface and the post plane have a curvilinear configuration.

18. The AMC according to claim 1, where the at least one post comprises a plurality of posts having an essentially common angle relative to the post plane.

19. The AMC according to claim 1, where the at least one post forms an angle in the range of about 60 degrees through about 90 degrees relative to the post plane.

20. An artificial magnetic conductor (AMC), comprising:

at least one frequency selective surface; and a post plane having at least one post assembly and at least one slot, where each post assembly comprises at least one post and at least one plate, where the at least one post assembly formably extends from the post plane, and where the at least one plate is operatively disposed adjacent to the at least one frequency selective surface.

21. The AMC according to claim 20, where the at least one plate forms a space between the at least one plate and the at least one frequency selective surface.

22. The AMC according to claim 21, where a dielectric film essentially fills the space.

23. The AMC according to claim 20, where the at least one plate is connected to at least one conductive shape on the at least one frequency selective surface.

24. The AMC according to claim 20, where the at least one plate forms at least one conductive shape on the at least one frequency selective surface.

25. The AMC according to claim 20, where the at least one frequency selective surface (FSS) comprises a double-sided FSS having conductive shapes arranged on a bottom layer and a top layer.

26. The AMC according to claim 25, where the at least one plate forms at least one of the conductive shapes on the bottom layer of the double-sided FSS.

27. The AMC according to claim 20, where the at least one plate has an essentially rectangular configuration.

28. The AMC according to claim 20, where the at least one conductive shape and the at least one post assembly have essentially the same periodic arrangement.

29. The AMC according to claim 20, further comprising a dielectric layer disposed between the post plane and the at least one frequency selective surface.

30. The AMC according to claim 20, further comprising a backing film disposed adjacent to the post plane.

31. The AMC according to claim 20, where the at least one frequency selective surface and the post plane have a curvilinear configuration.

32. The AMC according to claim 20, where the at least one post assembly further comprises at least one hinge portion.

33. The AMC according to claim 20, where the at least one plate further comprises at least one open section.

34. The AMC according to claim 33, where the at least one open section comprises three open sections, and where the at least one plate forms a rectangular cloverleaf configuration.

35. The AMC according to claim 20, where the at least one post assembly comprises a plurality of post assemblies having an essentially common angle relative to the post plane.

36. The AMC according to claim 20, where the at least one post assembly forms an angle in the range of about 60 degrees through about 90 degrees relative to the post plane.

37. A method for manufacturing an artificial magnetic conductor (AMC), comprising:

forming at least one post and at least one slot in a post plane, where the at least one post formably extends from the post plane; and operatively disposing the at least one post adjacent to at least one frequency selective surface.

38. The method for manufacturing an AMC according to claim 37, further comprising disposing a dielectric layer between the post plane and the frequency selective surface.

39. The method for manufacturing an AMC according t o claim 37, further comprising disposing a backing film adjacent to the post plane.

40. The method for manufacturing an AMC according to claim 37, where forming at least one post further comprises forming a tab.

41. The method for manufacturing an AMC according to claim 40, where forming the tab comprises forming at least one shoulder on the tab.

42. The method for manufacturing an AMC according to claim 41, where forming the tab further comprises forming a pin on the tab.

43. The method for manufacturing an AMC according to claim 42, further comprising disposing the pin in a hole formed by a conductive shape on the at least one frequency selective surface.

44. The method for manufacturing an AMC according to claim 37, where forming at least one post comprises forming a projection and a slot.

45. The method for manufacturing an AMC according to claim 43, where the projection essentially covers the slot on the post plane.

46. The method for manufacturing an AMC according to claim 37, further comprising forming a space between the frequency selective surface and the at least one post.

47. The method for manufacturing an AMC according to claim 37, where forming at least one post comprises forming a plurality of posts having a period less than the height of the posts.

48. The method for manufacturing an AMC according to claim 47, where the period is less than or equal to about one-half the height of the posts.

49. The method for manufacturing an AMC according to claim 37, further comprising forming the frequency selective surface and the post plane into a curvilinear configuration.

50. The method for manufacturing an AMC according to claim 37, further comprising forming the at least one post at an angle in the range of about 60 degrees through about 90 degrees in relation to the post plane.

51. A method for manufacturing an artificial magnetic conductor (AMC), comprising:

forming at least one post assembly and at least one slot in a post plane, where each post assembly comprises at least one post and at least one plate, where the at least one post assembly formably extends from the post plane; and operatively disposing the at least one plate adjacent to at least one frequency selective surface.

52. The method for manufacturing an AMC according to claim 51, further comprising forming a space between the at least one frequency selective surface and the at least one plate.

53. The method for manufacturing an AMC according to claim 52, further comprising disposing a dielectric film in the space.

54. The method for manufacturing an AMC according to claim 51, further comprising forming the at least one frequency selective surface and the post plane into a curvilinear configuration.

55. The AMC according to claim 51, further comprising connecting the at least one plate to at least one conductive shape on the at least one frequency selective surface.

56. The AMC according to claim 51, further comprising forming the at least one plate into at least one conductive shape on the at least one frequency selective surface.

57. The AMC according to claim 56, where the at least one frequency selective surface (FSS) comprises a double-sided FSS having conductive shapes arranged on a bottom layer and a top layer, and the at least one plate forms at least one of the conductive shapes on the bottom layer of the double-sided FSS.

58. The AMC according to claim 51, where forming the at least one post assembly further comprises forming the at least one plate with at least one open section.

59. The AMC according to claim 20, forming the at least one post assembly at an angle in the range of about 60 degrees through about 90 degrees relative to the post plane.

* * * * *

UNITED STATES PATENT AND TRADEMARK OFFICE

CERTIFICATE OF CORRECTION

PATENT NO. : 6,411,261 B1
DATED : June 25, 2002
INVENTOR(S) : James D. Lilly

It is certified that error appears in the above-identified patent and that said Letters Patent is hereby corrected as shown below:

Title page,
Item [56], OTHER PUBLICATIONS, delete "Sievenpper" and substitute -- Sievenpiper -- in its place.

Signed and Sealed this

Twenty-fifth Day of February, 2003

JAMES E. ROGAN
*Director of the United States Patent and Trademark Office*